US005450671A

United States Patent [19]

Harshman

[11] Patent Number: 5,450,671

[45] Date of Patent: Sep. 19, 1995

[54] HAIR TRIMMING DEVICE

[76] Inventor: David Harshman, 192 Nisbet Way, Riverside, Calif. 92507

[21] Appl. No.: 327,388

[22] Filed: Oct. 21, 1994

[51] Int. Cl.[6] ..... B26B 21/06

[52] U.S. Cl. ..... 30/31; 30/30

[58] Field of Search ..... 30/30, 31, 32, 50, 286, 30/287, 289, 294; 132/148

[56] References Cited

U.S. PATENT DOCUMENTS

| | | | |
|---|---|---|---|
| 1,276,022 | 8/1918 | Brasier | 30/31 |
| 1,384,691 | 7/1921 | Dunham . | |
| 1,890,334 | 12/1932 | Muros | 30/50 |
| 2,165,391 | 7/1939 | Lewis | 30/90 |
| 3,238,616 | 3/1966 | Eweson | 30/30 |
| 3,964,160 | 6/1976 | Gordon | 30/89 |
| 4,083,103 | 4/1978 | Estandian | 30/47 |
| 5,070,614 | 12/1991 | Hardin | 30/87 |
| 5,093,991 | 3/1992 | Hendrickson | 30/89 |

FOREIGN PATENT DOCUMENTS

| | | | |
|---|---|---|---|
| 2207879 | 2/1989 | United Kingdom | 30/32 |

*Primary Examiner*—Hwei Siu Payer

*Attorney, Agent, or Firm*—Macro-Search Corp.; Gene Scott

[57] ABSTRACT

An apparatus is provided for trimming and thinning hair through the maximum utilization of the slicing capacity of a straight razor. By employing a triangular, dualistic blade and comb configuration, the device channels and cuts the hair with an oblique, slicing motion without pulling or resisting the hair in any way. The device is comprised of a triangular body unit with two side walls, each extending the length of one of the longer body edges and raised vertically from the body. These walls form closed housing, each of which shelters a razor blade. In from of each razor is a series of combs which channel the hair evenly into the blades. The triangular shape of the device acts as a further channeling means, bringing hair into the wide end, through the combs to the blade edges and then out the narrow back end. The design further allows for multiple safety mechanisms, such as enclosed razor blades, bulbous protrusions covering each blade edge and a series of combs that prevent any skin from inadvertently coming into contact with the razor blades. The unique design of this invention lends itself to convenient trimming of the female pubic area, although it is by no means limited to such use.

9 Claims, 3 Drawing Sheets

HAIR TRIMMING DEVICE

FIELD OF THE INVENTION

This invention relates generally to shaving devices and more particularly to a thinning and trimming device with a unique triangular shape and a compact design that effectively utilizes the gradual slicing effect of a straight razor edge without scraping or contacting the skin, to be used primarily for thinning and trimming the female pubic area, but not limited to such use.

BACKGROUND OF THE INVENTION

Invention and use in the area of shaving devices is known to the public. However, while this invention uses the well known combination of straight razors and comb teeth to trim and thin hair, it employs them in a new configuration that effectively utilizes and maximizes the slicing effects of the blade, a capability that no prior art has yet attained.

The edge of a straight razor can generally be used in shaving and trimming in three different ways: scraping, chopping and slicing. In scraping, the blade edge of the razor attacks each hair or bristle in a relatively head-on manner, which results is tearing instead of angularly slicing the hairs to be removed. While this harsh treatment may be expected for uses such as plowing or grading a road, it seems out of place for hair removal on the face or any other area of the body. And yet, historically this is exactly the type of cutting motion that has been employed in standard safety razors. In fact, most close-shaving devices employ a combination of scraping and chopping to remove hair from an area.

Despite the common use of the scraping method of cutting, it is a well known fact that cutting blades generally provide superior cutting action when they are caused to slide along the object being cut while simultaneously advancing through it. This more gentle, effective manner of cutting is called slicing. In slicing, the blade approaches the individual hairs at an oblique angle, such that each hair is able to slide along the blade while being severed.

Thus, John Dunham modified the design of the shaving device with his Safety-Razor, U.S. Pat. No. 1,384,691 in 1921. His invention allowed for a safety razor in which the cutting edge of the blade was disposed at an oblique angle with respect to the longitudinal axis of the handle. With this invention, downward pull on the handle causes the blade to travel with or against the grain of the beard, cutting the beard but not scraping the skin. Dunham's invention also included a blade holder that could be set at any angle parallel to the surface of the human face, thereby allowing the blade to be positioned to cut either with or against the grain of the beard. A similar multi-positionable razor attempting to eliminate the scraping effect and utilize the slicing motion was introduced by Garron Gordon in U.S. Pat. No. 3,964,160 in 1976.

Over time, there have been several other attempts to create a razor capable of utilizing the slicing effect. Ramon Estandian's invention of U.S. Pat. No. 4,083,103 issued in 1978 details a razor that includes two shaft members with gears that mesh together so as to allow the head to rotate. Similarly, in 1991 Terril Hardin introduced U.S. Pat. No. 5,070,614 that disclosed a comparable rotatable razor assembly with a splined circular recess and a splined stub member allowing the head unit to be rotatably oriented in a single plane relative to the handle unit. Terrance Hendrickson also introduced a razor assembly that attempted to eliminate the scraping/chopping combination and move toward a slicing feature in U.S. Pat. No. 5,093,991 introduced in 1992. His razor configuration included a rearward mounting boss with a rearwardly oriented disc-like mating face formed from a plurality of radial grooves and ridges. When the mating faces are put intermeshed together, the shaving head assembly is adjustable by indexed rotation of the mating face of one assembly with respect to the other.

Unfortunately, this use of the slicing principle has a very small use in practical application because of the more prevalent danger of cutting the skin while employing the razor for skin-close shaving. Thus, it seems that the slicing abilities of a razor would be better utilized in conjunction with comb teeth for non-close type shaving, such as trimming and thinning of hair. However, to date there has been no prior art suggesting a configuration that effectively positions the blade and comb in such a way so as to utilize the slicing capacity of the blade.

One of the first blade and comb trimming assemblies was introduced U.S. Pat. No. 2,165,391 by Harrison Lewis in 1939. His invention detailed a blade and comb combination that could be readily attached to any commercial type of safety razor. This invention allowed for simultaneously combing, thinning and trimming hair symmetrically so as to not leave the hair in a uneven or ragged condition.

Another trimming device is evidenced in U.S. Pat. No. 3,358,367 to Samuel Bartley in 1967. His invention includes a bladeholder with two opposite edges, which are under corresponding reverse oblique and overlapping surfaces in fixed relation to a plane surface. The friction between the oblique surfaces is controlled by adjustments holding the bladeholder and blade tightly upon the plane surface and permitting them to reciprocate in directions parallel to the oblique surfaces.

Phung's U.S. Pat. Nos. 4,709,475 and Spanel's 3,803,712 further illustrate devices designed to employ a straight-edge razor and a series of comb teeth to trim hair. However, none of the prior art utilizes the more effective slicing abilities of the blade. Rather, they all cause the hairs to meet the blade in a head-on chopping manner due to the relationship of the comb teeth to the razor edge. This prevents the hairs from sliding along the blade, and thus, they must be chopped, not sliced.

A previous trimming device introduced by the instant inventor was detailed in the abandoned patent application Ser. No. 08/043,289 in 1993. This invention sought to employ an adjustable blade and comb assembly to trim hair by utilizing the slicing abilities of the blade.

However, this application, as well as much of the prior trimming art, incurred a serious problem evident in much of the prior art. The common problem is that the assembly provides a stiff, unyeilding resistance of the blade when it engages the hair, thereby pulling the hair and causing pain. The setting of the blade at an angle from the skin is alone not enough to overcome the pulling problem.

Thus, there is a need for a trimming device that effectively and simply utilizes the comb and blade assembly in such a way so as to maximize the slicing ability of the razor while eliminating the pulling resistance on the hair. The present invention fulfills these needs and provides further related advantages.

SUMMARY OF THE INVENTION

In the prior art trimmers, often additional attachments and combs are needed to accomplish the desired task, but that is not the case with the present invention. The present invention does away with the use of the elongated handle so common to adjustable safety razors. So too does it rid the need for large body units that alternately serve as a gripping mechanism. Rather, the current invention is small and compact enough to easily be gripped end-to-end between the thumb and the index finger. Incorporated in this compact structure is a grooved notch which captures, channels and compresses hairs towards the blade edges. In addition the dual blade construction of the invention eliminates the need for indexing of the blade head, thus allowing for a greater simplicity of use. Essentially, the present invention is designed to meet the need for a close shaving trimmer that is compact and lightweight enough so as to provide a shaving device that is easy and convenient enough to handle in even the most delicate areas, such as the female pubic area.

The present invention is a thinning and trimming device for non-close shaving. Its primary intended use is for female pubic hair trimming, although use is not limited to this application. In general, the device is composed of an acute triangular body with elongate blade support running along each of the longer edges to form a V-shaped opening. A pair of elongate razor blades are permanently fixed within these support walls, and a series of comb teeth align and position the hairs before the hairs move against the razors blades, and, importantly, prevent the skin from being cut.

The triangular design of the apparatus works to capture, channel and compress hairs toward the blade edges. The comb teeth further help to channel and position the hairs, maximizing the even quality of the trim. And, as a final method of channeling the hair out of the device, an upright element such as a cylinder may be placed near the rear of the device so as to channel and dam the individual hairs near the exit.

The enclosed housing design of the invention prevents exposure of the razor blade edges to the handling areas of the device. This ensures greater safety, since there are no outwardly exposed blades. As a further safety feature, each of the support walls includes a pair of bulbous protrusions that extend outwardly from the wall so as to enclose the side edges of each of the razor blades. And finally, the comb teeth serve as an additional safety feature, working as skin deflectors and tactile indicators.

The structure of the new invention functions so as to eliminate the need for a handle or like device. This is accomplished by the compact structure and design of the invention, and a gripping means positioned on the top surface of the body. This gripping means allows the user to easily hold each end of the device firmly between the thumb and the index finger, or any other more comfortable configuration. From this gripping means the device is not only secured, but the direction of movement is manipulated. In this way, the user is able to grip the apparatus at an angle nearly parallel to the blades, rather than the more perpendicular method employed by commercial safety razors. In addition, by eliminating a handle-type mechanism, the user manipulates the blade from a shorter distance, thereby gaining finer precision and control.

Thus, it is an object of the invention to provide a substantial advance over the prior art by successfully utilizing the slicing capabilities of a straight edge razor in a practical and efficient form using two blades to double the rate of cut and eliminate the need for indexing. Furthermore, by employing a dual, opposing, preset blade configuration, the present invention creates a channeling effect which increases the rate of cut as the trimming stroke progresses since the hairs are channeled between the blades. This process allows the device to simply and effectively trim and thin hairs by using the slicing principle. In addition, the device lacks the stiff, unyielding resistance present in much of the prior art, and thus effectively eliminates the hair pulling effects commonly associated with such prior art devices. These features allow the device to cut hairs in a slicing motion with optimum efficiency.

It is also an object of the current invention to be constructed so as to facilitate safe, gentle and easy hair removal from even the most delicate areas, such as the female pubic area. To accomplish this, it is a further object of the invention to be constructed so that the razor blades may be positioned to shave close, but never actually contact the skin's surface, so as to avoid cutting or irritating the skin.

Still further, it is an object of the invention to be designed to provide increased safety mechanisms. The present invention accomplishes this through three separate safety mechanisms: an enclosed housing unit, bulbous protrusions preceding the blade edges and a series of comb teeth parallel to the blades.

It is also an object of the invention to improve upon the gripping devices of the prior art. Thus it is an object of the new invention to be small enough so as to be easily held between the thumb and the index finger on the top surface of the device. Further, it is an object of the present device to allow the user increased control and maneuverability by decreasing the distance between the user's point of leverage and the blades themselves.

Finally, it is an object of the present invention to be of a simple structure with relatively few parts so as to allow for inexpensive manufacture and pricing. It is a further object of the invention to be compact and lightweight so as to easily be handled and transported while still retaining its durability.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
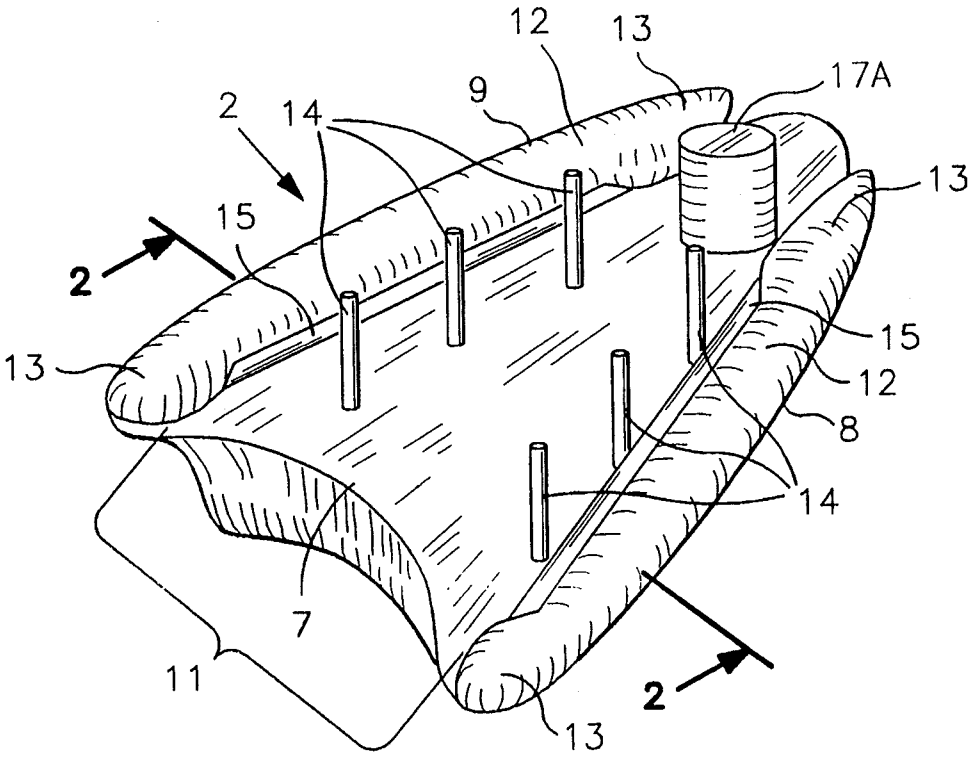
FIG. 1 is a perspective view of the invention showing the enclosed housing, comb teeth, side walls, blades, and the bulbous protrusions preceding the blades.
Figure 2:
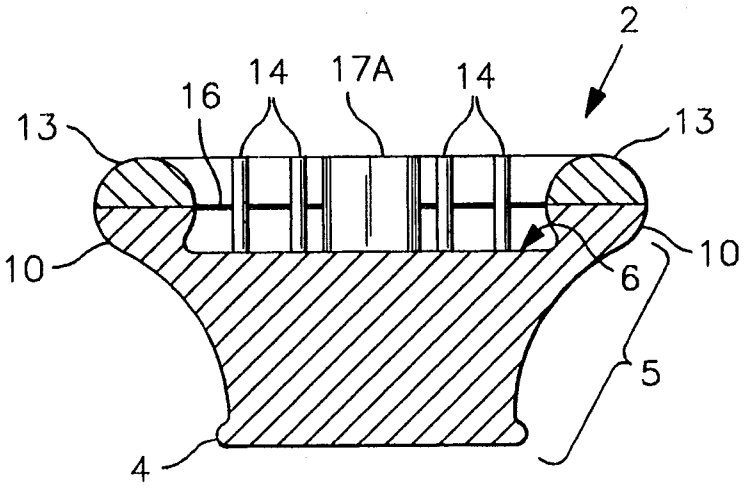
FIG. 2 is a cross-sectional view of the device of FIG. 1, along line 2—2 thereof, and 18 demonstrating the relative positions and alignment of the various elements of the device.
Figure 3:
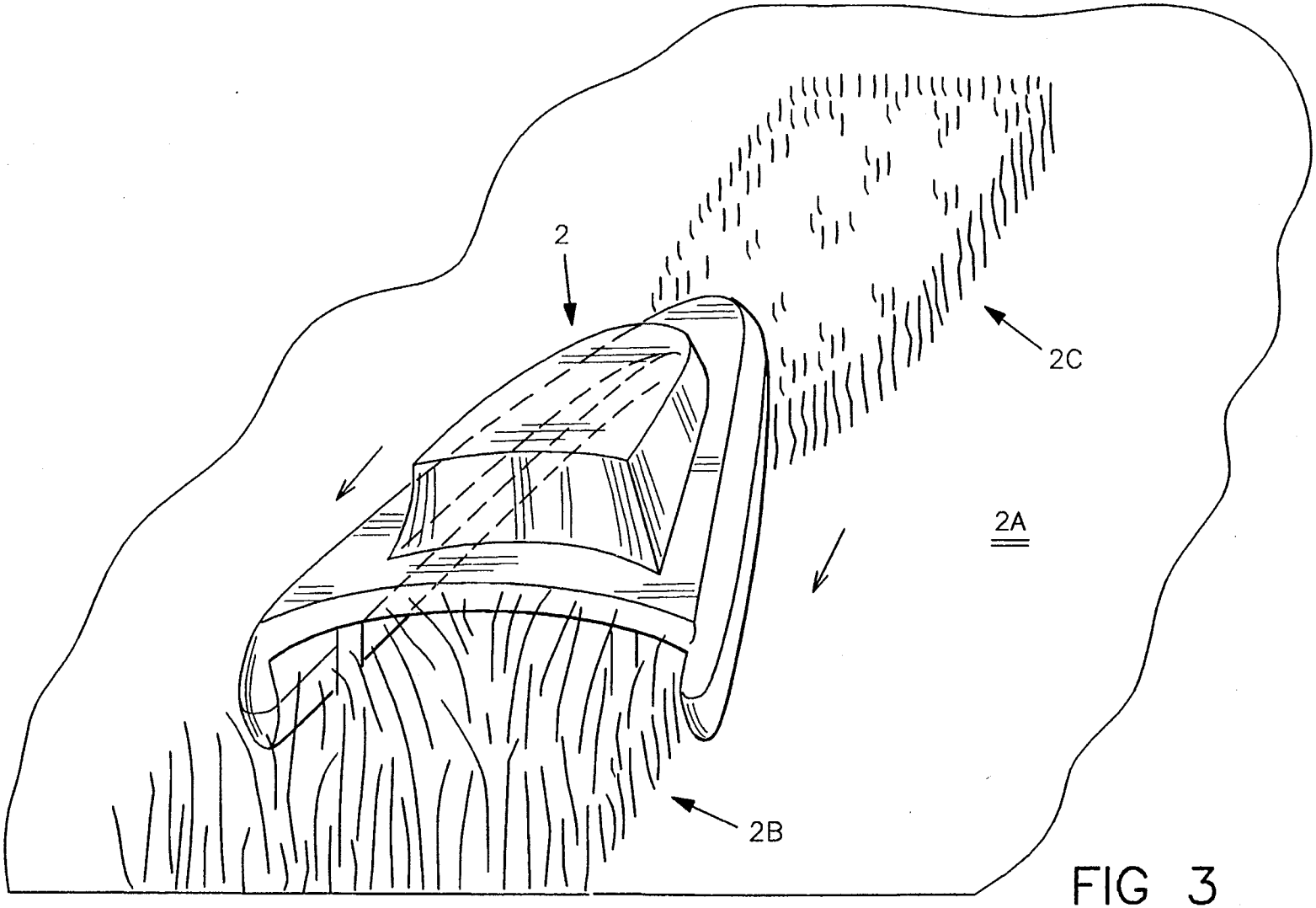
FIG. 3 is a perspective view of the device showing the cutting action possible with said device.

FIGS. 1–3 show a device 2 for non-close shaving of hair. The device 2 is made up of an integral body 5 with a flat base surface 6 peripherally defined by three triangularly arranged edges 7, 8 and 9. A pair of elongate blade support walls 10 are arranged along the two longer edges 8 and 9 of the base surface 6, thus defining a V-shaped opening 11 between them. These support walls 10 originate at the base surface 6, are formed integrally with the body 5 and terminate with a skin contact surface 12.

A pair of elongate razor blades 15 extend colinearly with the support walls 10 and are held fixedly within them. These razor blades 15 are parallel to and spaced apart from the base surface 6, each blade thereby providing a keen edge 16 facing the V-shaped opening 11. Each of the razor blades 15 has a pair of opposing side edges defining the length of the blade 15. Each of these side edges of the razor blade 15 is preceeded and succeeded by a bulbous protrusion 13, with the bulbous protrusion 13 integrally included into the ends of each of the support wall 10 and extending outwardly from them.

Further, the side walls 10 angle away from each other so as to form a wide gap at the third of the three edges 7. This edge 7 defines the leading edge of the device 2 that allows the hairs to move into the V-shaped opening 11. Thus, the narrow gap between the apex of the two edges 8 and 9 define the trailing edge of the device 2. This narrow gap permits the hairs to move out of the V-shaped opening 11. Near this narrow gap, centered between the side wall 10 and slightly behind the bulbous protrusions 13, may be an upright boss 17A, preferably of cylindrical shape and preferably having a circular wall, designed to act as a dam causing the hairs to push back against incoming hairs to cause the incoming hairs to flow against the blades 15.

A plurality of comb teeth 14 extend from the base surface 6 and are utilized to deflect skin down and away from the blade, forming tactile indicators of the skin surface plane. They also work to align and position the hairs to move against the keen edges 16. These combs 14 are positioned in two rows, the rows being parallel to and offset from the pair of keen edges 16.

As evidenced in FIG. 2, all features protruding vertically from the bottom of the base 6, such as combs 14, and the skin contact surface 12 are raised in equal horizontal alignment, thus forming a smooth surface for skin contact.

Intrinsic to the body 5 is a gripping means 4, located on the top edge of the body 5. This means extends outwardly from the body, :providing a surface for convenient gripping and manipulation of the device.

FIG. 3 shows a typical result of the present invention device 2 as used on a surface 2A. As long hairs 2B enter the device 2 they are driven against the opposing blades 15 and cut to a relatively uniform height to emerge from the device as shorter hairs 2C.

While the invention has been described with reference to a preferred embodiment, it is to be clearly understood by those skilled in the art that the invention is not limited thereto. Rather the scope of the invention is to be interpreted only in conjunction with the appended claims.

What is claimed is:

1. A device for non-close shaving of body hairs comprising:

an integral body including a planar base surface peripherally defined by three triangularly arranged edges;

a pair of elongate blade support walls defining a V-shaped opening therebetween, the walls arranged along two of the edges respectively, each extending from the base surface, and terminating with a skin contact surface; and a pair of elongate razor blades held fixedly within, and extending colinearly with the support walls respectively, in parallel with the base surface and spaced apart therefrom, each providing a keen edge facing the V-shaped opening.

2. The device of claim 1 wherein each of the razor blades has a pair of opposing side edges defining a razor blade length therebetween, each of the support walls further including a pair of bulbous protrusions extending outwardly therefrom, enclosing the side edges of one of the razor blades respectively.

3. The device of claim 2 wherein the support walls define a leading gap therebetween along a third of the three edges, further defining a leading edge of the device, the hairs moving into the V-shaped opening of the device as the device is moved over the hairs; and a more narrow trailing gap therebetween at an apex of the two of the edges, defining a trailing edge of the device, the more narrow gap providing a path for the hairs to move out of the V-shaped opening.

4. The device of claim 3 further including a plurality of comb teeth extending from the planar base surface for aligning and positioning the hairs to move against the keen edges and to act as a barrier to non-hair elements moving near the keen edges.

5. The device of claim 4 wherein the comb teeth are positioned in two rows, the rows positioned parallel to and offset from the pair of keen edges respectively.

6. The device of claim 5 wherein the body and blade support walls are formed integrally.

7. The device of claim 6 wherein the body further includes a boss extending outwardly therefrom for holding, gripping and manipulating the device.

8. The device of claim 7 further including a boss extending from the planar base surface adjacent the more narrow gap and having a shape and size causing the hairs to press together and bunch-up so as to flow more smoothly into the blades.

9. The device of claim 8 wherein the boss extending from the planar base surface includes an exterior circular surface for contacting the hairs.

* * * * *